US010546530B2

(12) United States Patent
Lee

(10) Patent No.: US 10,546,530 B2
(45) Date of Patent: Jan. 28, 2020

(54) PIXEL DRIVING CIRCUIT AND DISPLAY DEVICE THEREOF

(71) Applicant: HON HAI PRECISION INDUSTRY CO., LTD., New Taipei (TW)

(72) Inventor: Kuo-Sheng Lee, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/039,022

(22) Filed: Jul. 18, 2018

(65) Prior Publication Data

US 2019/0355301 A1 Nov. 21, 2019

(30) Foreign Application Priority Data

May 16, 2018 (CN) ..... 2018 1 0467224

(51) Int. Cl.
*G09G 3/3233* (2016.01)
*G09G 3/3275* (2016.01)
*G09G 3/3266* (2016.01)

(52) U.S. Cl.
CPC ..... *G09G 3/3233* (2013.01); *G09G 3/3266* (2013.01); *G09G 3/3275* (2013.01); *G09G 2330/028* (2013.01)

(58) Field of Classification Search
CPC .. G09G 3/3233; G09G 3/3266; G09G 3/3275; G09G 2330/028
See application file for complete search history.

(56) References Cited

U.S. PATENT DOCUMENTS

2006/0007073 A1 1/2006 Kwak et al.
2016/0117981 A1* 4/2016 Lee ..... G09G 3/3233 345/214

FOREIGN PATENT DOCUMENTS

CN 105528997 A * 4/2016 ..... G09G 3/2092

* cited by examiner

*Primary Examiner* — Stacy Khoo
(74) *Attorney, Agent, or Firm* — ScienBiziP, P.C.

(57) ABSTRACT

This disclosure relates to a pixel driving circuit for driving a pixel group with two adjacent pixel units. The pixel group includes a first pixel unit and a second pixel unit. Each pixel driving circuit is capable of driving the first pixel unit and the second pixel unit in one same pixel group. The pixel driving circuit includes a driving module, a first switching module, and a second switching module. The driving module includes a control terminal, a first connecting terminal, a second connecting terminal and a driving transistor, and the control terminal is capable of storing voltage, the driving module is configured to adjust and control the magnitude of an electrical signal passing through the driving transistor due to the voltage stored at the control terminal. A display device having the pixel driving circuit is also provided.

4 Claims, 14 Drawing Sheets

PIXEL DRIVING CIRCUIT AND DISPLAY DEVICE THEREOF

FIELD

The present disclosure relates to a pixel driving circuit and a display device thereof.

BACKGROUND

With the continuous development of electronic technologies, most consumer electronic products such as mobile phones, portable computers, personal digital assistants (PDAs), tablet computers, and media players use monitors as input and output devices, making products more friendly to human-computer interaction. Organic light emitting diodes (OLEDs) or micro light emitting diodes (LEDs) are used as a light emitting device because of its self-luminous, fast response, wide viewing angle and can be fabricated on flexible substrates. Other features are increasingly used in high-performance display areas. A display device using a light emitting element generally defines a display area and a non-display area. A plurality of pixel units arranged in a matrix are located in the display area. Each pixel unit corresponds to one pixel driving circuit. A display driving circuit for driving the pixel driving circuit is located in the non-display area. The pixel driving circuit includes a selection transistor, a driving transistor, a storage capacitor, and a light emitting element. When a size of the display increases, as the number of pixel units increases, a size of the display driving circuit for driving the pixel driving circuit also increases accordingly, resulting in an excessively large area of the non-display area. As the demand for narrow borders increases, the area of the non-display area decreases. Thus, the circuit structure of the display device needs to be simplified.

Therefore, there is room for improvement in the art.

BRIEF DESCRIPTION OF THE DRAWINGS

Implementations of the present disclosure will now be described, by way of example only, with reference to the attached figures.

DETAILED DESCRIPTION

Figure 1:
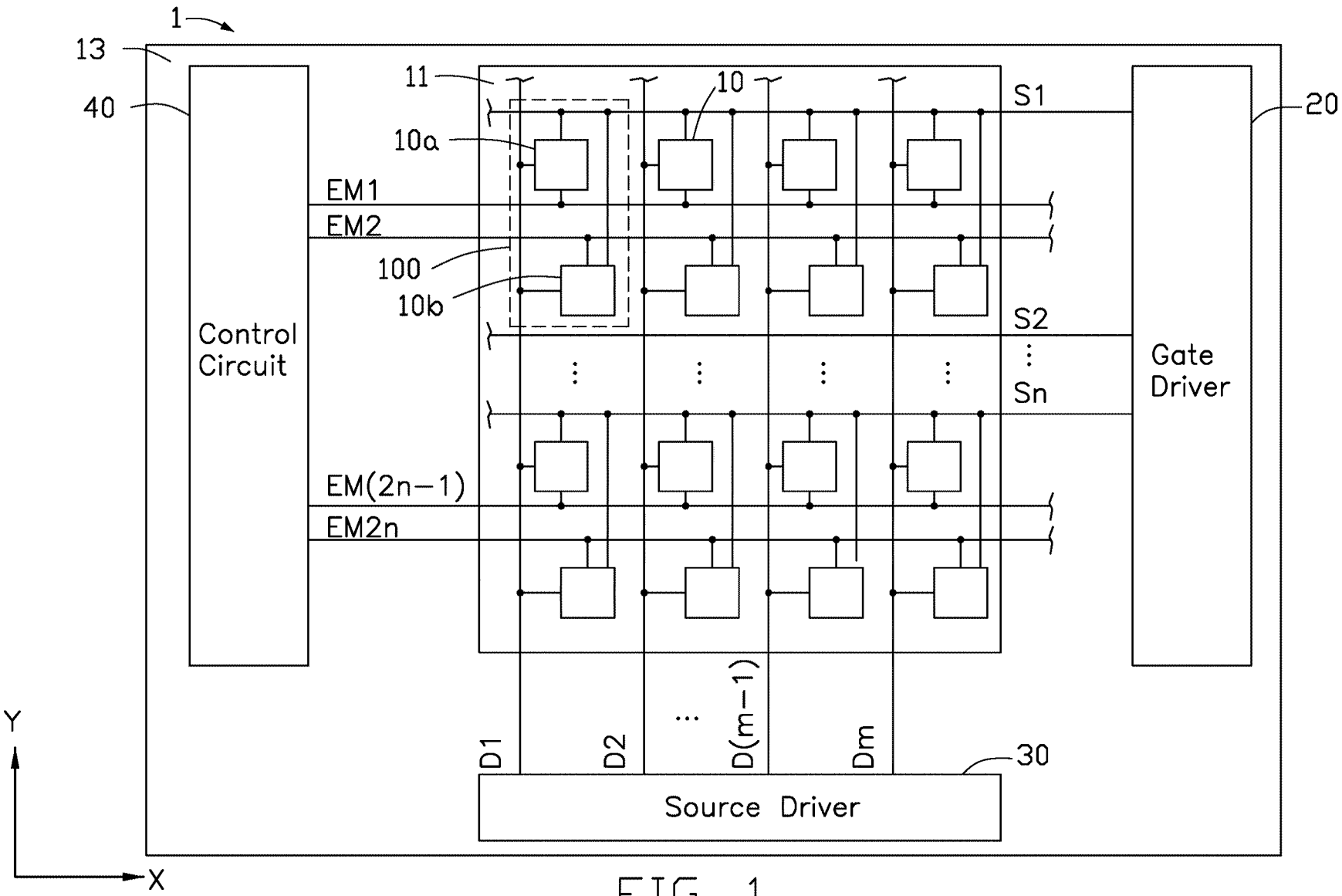
FIG. 1 is a block diagram of a first embodiment of a display device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein may be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one." The term "circuit" is defined as an integrated circuit (IC) with a plurality of electric elements, such as capacitors, resistors, amplifiers, and the like.

FIG. 1 illustrates a display device 1 according to a first embodiment. In FIG. 1, the display device 1 includes a plurality of data lines D1-Dm extending along a first direction Y, a plurality of scan lines S1-Sn extending along a second direction X, and a plurality of control lines EM1-EM(2*n*) extending along the second direction X. The second direction X is perpendicular to the first direction Y Among them, n is an integer which is larger than or equal to 2, and m is an integer which is larger than or equal to 1. The scan lines S1-Sn and the control lines EM1-EM(2*n*) are insulated from the data lines D1-Dm. The scan lines S1-Sn, the control lines EM1-EM(2*n*), and the data lines D1-Dm cross with each other in a grid, and define a plurality of pixel units 10.

In FIG. 1, the display device 1 further includes a source driver 30, a gate driver 20, and a control circuit 40. The data lines D1-Dm are electrically connected to the source driver 30. The scan lines S1-Sn are electrically connected to the gate driver 20. The control lines EM1-EM(2*n*) are electrically connected to the control circuit 40.

In FIG. 1, the display device 1 further defines a display region 11 and a non-display region 13 surrounded with the display region 11. The data lines D1-Dm, the scan lines S1-Sn, the control lines EM1-EM(2*n*), and the pixel units 10 are disposed in the display region 11. The source driver 30, the gate driver 20, and the control circuit 40 are disposed in the non-display region 13.

In this embodiment, the gate driver 20 and the control circuit 40 are disposed at opposite sides of the non-display region 13. The source driver 30 is disposed on the side where the non-display region 13 is not provided with the gate driver 20 and the control circuit 40. The source driver 30 drives the data lines D1-Dm, the gate driver 20 drives the scan lines S1-Sn, and the control circuit 40 drives the control lines EM1-EM(2*n*).

In this embodiment, the gate driver 20 and the source driver 30 may be connected to pads (not shown) on a display panel of the display device 1 through a tape-automated bonding (TAB) method or through a chip-on-glass (COG) method and may also be directly disposed on the display panel of the display device 1 through a gate-on-panel (GOP) method. In other embodiments, the gate driver 20 and the source driver 30 may also be directly integrated on the display panel as part of the display panel of the display device 1.

In other embodiments, a timing controller may be disposed in the non-display region 13. The timing controller is used to provide a plurality of synchronization control signals to the gate driver 20 and the source driver 30. The synchronization control signals may include a horizontal synchronization (Hsync) signal, a vertical synchronization (Vsync) signal, a clock (CLK) signal, a data enable (EN) signal, and the like.

Figure 2:
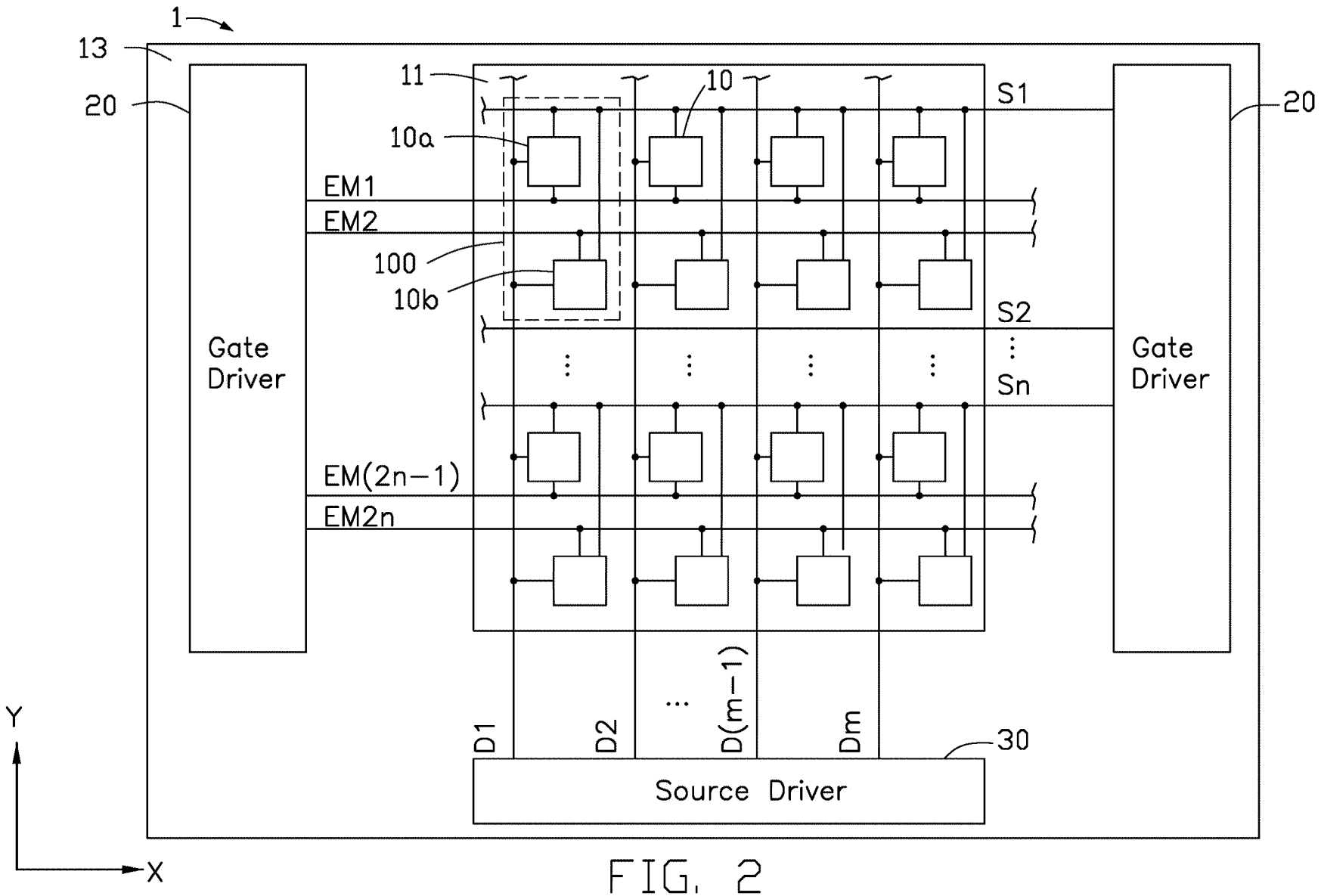
FIG. 2 is a block diagram of a second embodiment of a display device.

FIG. 2 illustrates a display device 1 according to a second embodiment. In FIG. 2, the display device 1 includes a source driver 30 and two gate drivers 20. The two gate drivers 20 are disposed at opposite sides of the non-display region 13. The source driver 30 is disposed on the side where the non-display region 13 is not provided with the gate driver 20. The gate driver 20 disposed on a right side of the non-display region 13 is configured to drive the scan lines S1-Sn, where n is an integer which is larger than or equal to 2, and the gate driver 20 disposed on a left side of the non-display region 13 is configured to drive the control lines EM1-EM(2*n*). That is, control signals loaded on the control lines EM1-EM(2*n*) may also be provided by the gate driver 20.

Figure 3:
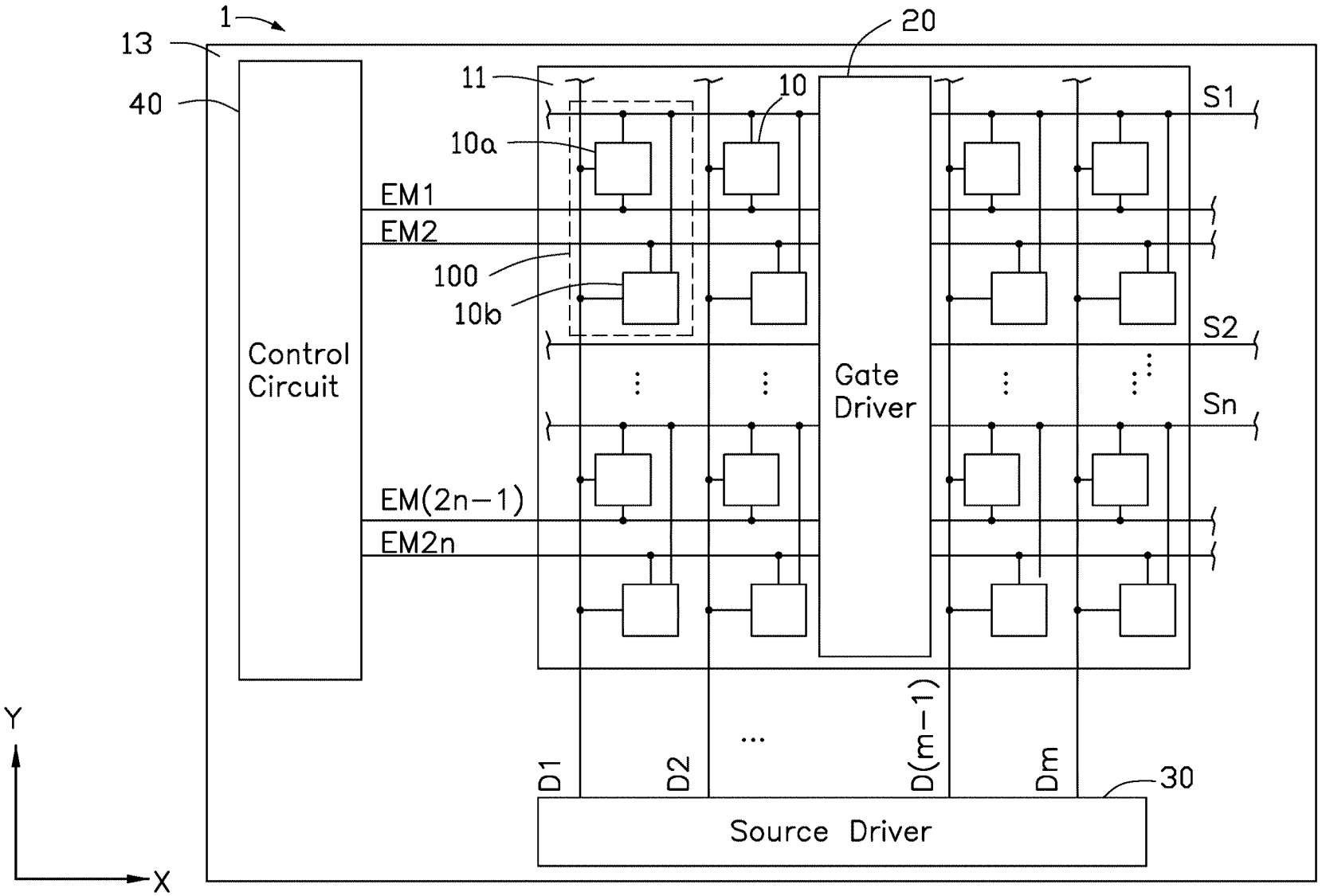
FIG. 3 is a block diagram of a third embodiment of a display device.

FIG. 3 illustrates a display device 1 according to a third embodiment. In FIG. 3, the display device 1 includes a source driver 30, a gate driver 20, and a control circuit 40. Compared with the prior art, the number of scan lines S1-Sn shown in FIG. 3 is reduced by half, there are fewer leads connected to the gate driver 20. Thus, the gate driver 20 can be disposed in the display region 11, and the display device 1 can achieve a narrow border design.

Referring to FIG. 1, the pixel units 10 are arranged in a matrix, and the pixel units 10 defines a plurality of pixel groups 100. Each pixel group 100 includes a first pixel unit 10*a* and a second pixel unit 10*b* which is adjacent to the first pixel unit 10*a* along the first direction Y In one same pixel group 100, the first pixel unit 10*a* and the second pixel unit 10*b* are electrically connected to the same scan line Sn and the same data line Dm, but are respectively electrically connected to the control lines EM(2*n*−1)-EM(2*n*). The first pixel unit 10*a* is electrically connected to the control line EM(2*n*−1), and the second pixel unit 10*b* is electrically connected to the control line EM(2*n*). Each pixel group 100 is electrically connected to the gate driver 20 by one scan line Sn, is electrically connected to the source driver 30 by one data line Dm, and is electrically connected to the control circuit 40 by two control lines EM(2*n*−1)-EM(2*n*).

In this embodiment, each pixel unit 10 includes a light emitting element (not shown) to generate light required for display device 1. The light emitting element may be an Organic Light Emitting Diode (OLED) or a micro Light Emitting Diode (pLED).

In this embodiment, the display device 1 may include light emitting elements that emit blue light, green light, and red light, respectively. Light-emitting elements emitting light of different colors are disposed in different pixel units 10. Alternatively, the display device 1 may also include only light emitting elements for emitting white light, and further have a color filter layer. Alternatively, the display device 1 may include only light emitting elements emitting light of a first primary color, and further include a quantum dot film. The light of the first primary color light emitted by the light emitting elements is converted by the quantum dot film, thus light of other primary color light can be obtained.

In this embodiment, each pixel group 100 includes a pixel driving circuit. In each pixel group 100, the first pixel unit 10*a* is provided with at least a part of the pixel driving circuit including a transistor controlled by a scan signal loaded on a scan line and a driving transistor for supplying an electric signal for light emission to the light emitting element of the first pixel unit 10*a*. The second pixel unit 10*b* is provided with at least another part of the same pixel driving circuit including a driving transistor for supplying an electric signal for light emission to the light emitting element of the second pixel unit 10*b*. In other words, the same pixel driving circuit can not only drive the light emitting conditions of the light emitting element of the first pixel unit 10*a*, but also drive the light emitting conditions of the light emitting element of the second pixel unit 10*b*. The light emitting conditions include whether the light emitting element emits light and the light emitting intensity of the light emitting element.

Figure 4:
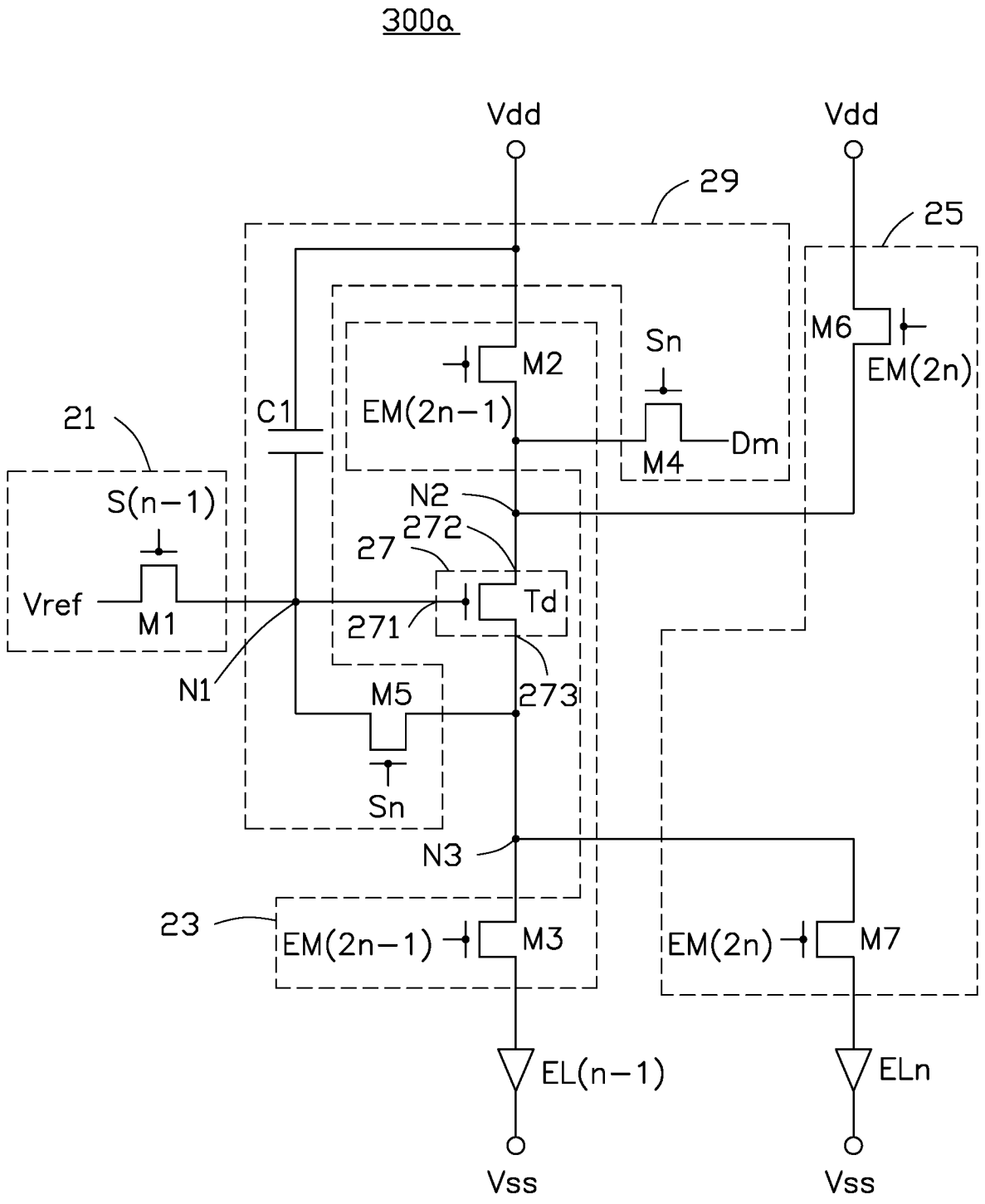
FIG. 4 is a circuit diagram view of a pixel driving circuit of FIG. 1.

FIG. 4 illustrates a pixel driving circuit 300*a* applied to the pixel group 100. FIG. 4 illustrates only one exemplary pixel group 100, and other pixel groups 100 respectively have the same pixel driving circuit 300*a*. Each pixel group 100 includes one pixel driving circuit 300*a*. The pixel driving circuit 300*a* is electrically connected to the two adjacent scan lines S(n−1)-Sn, one data line Dm, wherein m is an integer which is larger than or equal to 1, and the two adjacent control lines EM(2*n*−1)-EM(2*n*).

In this embodiment, the pixel driving circuit 300*a* receives the signal of the previous scan line S(n−1) as a reset signal, receives the signal of the corresponding scan line Sn as a scan signal, receives the signal of the corresponding data line Dm as a data signal, receives the signal of the control line EM(2*n*−1) as a first control signal, and receives the signal of the control line EM(2*n*) as a second control signal. The scan signals of the two adjacent scan lines S(n−1)-Sn are sequentially shifted. The pixel driving circuit 300*a* drives the first pixel unit 10*a* and the second pixel unit 10*b* in the pixel group 100 in time division.

In FIG. 4, the pixel driving circuit 300*a* includes a reset module 21, a first switching module 23, a second switching module 25, a driving module 27, a common compensation module 29, a first light emitting element EL(n−1), and a second light emitting element ELn. The first light emitting element EL(n−1) corresponds to the first pixel unit 10*a*, and the second light emitting element ELn corresponds to the second pixel unit 10*b*. The circuit formed by the reset module 21, the first switching module 23, the driving module 27, and the common compensation module 29 is used to drive the first pixel unit 10*a*. The circuit formed by the reset module 21, the second switching module 25, the driving module 27, and the common compensation module 29 is used to drive the second pixel unit 10*b*. That is, the first pixel unit 10*a* and the second pixel unit 10*b* share the reset module 21, the driving module 27, and the common compensation module 29.

In this embodiment, from the perspective of circuit layout, the reset module 21, the first switching module 23, the driving module 27, and the common compensation module 29 correspond the first pixel unit 10*a*, and the second switching module 25 corresponds to the second pixel unit 10*b*. Alternatively, one or more of the reset module 21, the driving module 27, and the common compensation module 29 may be correspondingly disposed in the second pixel unit 10*b*.

In FIG. 4, the driving module 27 includes a control terminal 271, a first connecting terminal 272 and a second connecting terminal 273, and a driving transistor Td. In this embodiment, the driving module 27 adjusts and controls the magnitude of the driving current passing through the driving transistor Td due to the voltage stored on the side where the control terminal 271 is located, thereby controlling the brightness and the gray level of the pixel unit 10*a* and second pixel unit 10*b* located therein. A gate electrode of the driving transistor Td is electrically connected to the control terminal 271, a source electrode of the driving transistor Td is electrically connected to the first connecting terminal 272, and a drain electrode of the driving transistor Td is electrically connected to the second connecting terminal 273. The driving transistor Td has a threshold voltage Vth. In this embodiment, the driving transistor Td is a P-type thin film transistor.

In this embodiment, a connecting node between the control terminal 271 of the driving module 27, the reset module 21, and the common compensation module 29 is defined as a first node N1. A connecting node between the first connecting terminal 272 of the driving module 27, the first switching module 23, and the second switching module 25 is defined as a second node N2. A connecting node between the second connecting terminal 273 of the driving module 27, the first switching module 23, and the second switching module 25 is defined as a third node N3.

In FIG. 4, the control terminal 271 of the driving module 27, the reset module 21, and the common compensation module 29 are electrically connected to the first node N1. The first connecting terminal 272 of the driving module 27, the first switching module 23 and the second switching module 25 are electrically connected to the second node N2. The second connecting terminal 273 of the driving module 27, the first switching module 23, and the second switching module 25 are electrically connected to the third node N3.

In this embodiment, the first switching module 23 controls whether the power voltage Vdd is provided to the first connecting terminal 272 of the driving module 27 due to the loaded first control signal of the control line EM(2*n*−1), and controls whether the driving current generated by the driving module 27 is provided to the first light emitting element EL(n−1) due to the control line EM(2*n*−1).

In FIG. 4, the first switching module 23 includes a first transistor M2 and a second transistor M3. The first transistor M2 is electrically connected between the power voltage Vdd and the first node N1. A gate electrode of the first transistor M2 is electrically connected to the control line EM(2*n*−1) to receive the first control signal. A source electrode of the first transistor M2 is electrically connected to the power voltage Vdd. A drain electrode of the first transistor M2 and the first connecting terminal 272 of the driving module 27 are electrically connected to the first node N1.

In FIG. 4, the second transistor M3 is electrically connected between the third node N3 and the first light emitting element EL(n−1). A gate electrode of the second transistor M3 is electrically connected to the control line EM(2*n*−1) to receive the first control signal of the control line EM(2*n*−1). A source electrode of the second transistor M3 and the second connecting terminal 273 of the driving module 27 are electrically connected to the third node N3. A drain electrode of the second transistor M3 is electrically connected to the first light emitting element EL(n−1). In this embodiment, the first transistor M2 and the second transistor M3 are P-type thin film transistors, and the power voltage Vdd is greater than the reference voltage Vref.

In this embodiment, the second switching module 25 controls whether the power voltage Vdd is provided to the first connecting terminal 272 of the driving module 27 due to the loaded second control signal of the control line EM(2*n*), and controls whether the driving current generated by the driving module 27 is provided to the second light emitting element ELn.

In FIG. 4, the second switching module 25 includes a third transistor M6 and a fourth transistor M7. The third transistor M6 and the first transistor M2 are electrically connected in parallel between the power voltage Vdd and the second node N2. A gate electrode of the third transistor M6 is electrically connected to the control line EM(2*n*) to receive the second control signal. A source electrode of the third transistor M6 is electrically connected to the power voltage Vdd. The drain electrode of the third transistor M6 and the first connecting terminal 272 of the driving module 27 are electrically connected to the second node N2.

In FIG. 4, the fourth transistor M7 is electrically connected between the third node N3 and the second light emitting element ELn. A gate electrode of the fourth transistor M7 is electrically connected to the control line EM(2*n*) to receive the second control signal. A source electrode of the fourth transistor M7 and the second connecting terminal 273 of the driving module 27 are electrically connected to the third node N3. A drain electrode of the fourth transistor M7 is electrically connected to the second light emitting element ELn. In this embodiment, the third transistor M6 and the fourth transistor M7 are all P-type thin film transistors.

In this embodiment, the common compensation module 29 writes and stores a data voltage loaded on the data line Dm for compensating the voltage of the control terminal 271 and the voltage of the gate electrode of the driving transistor Td due to a loaded scanning signal, thus the driving module 27 is compensated.

In FIG. 4, the common compensation module 29 includes a scan transistor M4, a compensation transistor M5, and a storage capacitor C1. A gate electrode of the scan transistor M4 is electrically connected to the scan line Sn to receive a scan signal. A source electrode of the scan transistor M4 is electrically connected to the data line Dm to receive the data voltage for compensating the voltage of the control terminal 271 and the voltage of the gate electrode of the driving transistor Td. A drain electrode of the scan transistor M4 is electrically connected to the second node N2, and is further electrically connected to the first connecting terminal 272 and the source electrode of the driving transistor Td.

In FIG. 4, a gate electrode of the compensation transistor M5 is electrically connected to the scan line Sn. A source electrode of the compensation transistor M5 is electrically connected to the second connecting terminal 273, and is further electrically connected to the drain electrode of the driving transistor Td. The drain electrode of the compensation transistor M5 is electrically connected to the first node N1, and further electrically connected to the control terminal 271 and the gate electrode of the driving transistor Td.

In FIG. 4, the first terminal of the storage capacitor C1 receives the power voltage Vdd, the second terminal of the storage capacitor C1 is electrically connected to the first node N1, and further electrically connected to the control terminal 271 and the gate electrode of the driving transistor Td. In this embodiment, the scan transistor M4 and the compensation transistor M5 are both P-type thin film transistors. In this embodiment, the reference voltage Vref is smaller than the data voltage Vdata and the threshold voltage Vth.

In FIG. 4, an anode of the first light-emitting element EL(n−1) is electrically connected to the drain electrode of the driving transistor Td via the second transistor M3, and a cathode of the first light-emitting element EL(n−1) is grounded. An anode of the second light emitting element ELn is electrically connected to the drain electrode of the driving transistor Td via the fourth transistor M7, and a cathode of the second light emitting element ELn is grounded.

In this embodiment, the reset module 21 receives a signal of the scan line S(n−1) as a reset signal. Due to the reset signal, the voltage of the control terminal 271 of the driving module 27 is reset to the reference voltage Vref. Thus, the operating state of the driving transistor Td is reset.

In FIG. 4, the reset module 21 includes a reset transistor M1. A gate electrode of the reset transistor M1 is electrically connected to the scan line S(n−1). A drain electrode of the reset transistor M1 receives the reference voltage Vref. A source electrode of the reset transistor M1 is electrically connected to the first node N1, and further electrically connected the control terminal 271 and the gate electrode of the driving transistor Td. In this embodiment, the reset transistor M1 is a P-type thin film transistor.

In this embodiment, the gate electrode of the reset transistor M1 receives a signal of the scan line S(n−1) as the reset signal. The drain electrode of the reset transistor M1 receives the reference voltage Vref. The reference voltage Vref is transmitted to the first node N1 and thus the voltage of the control terminal 271 and the voltage of the gate electrode of the driving transistor Td are reset to the reference voltage Vref.

Figure 5:
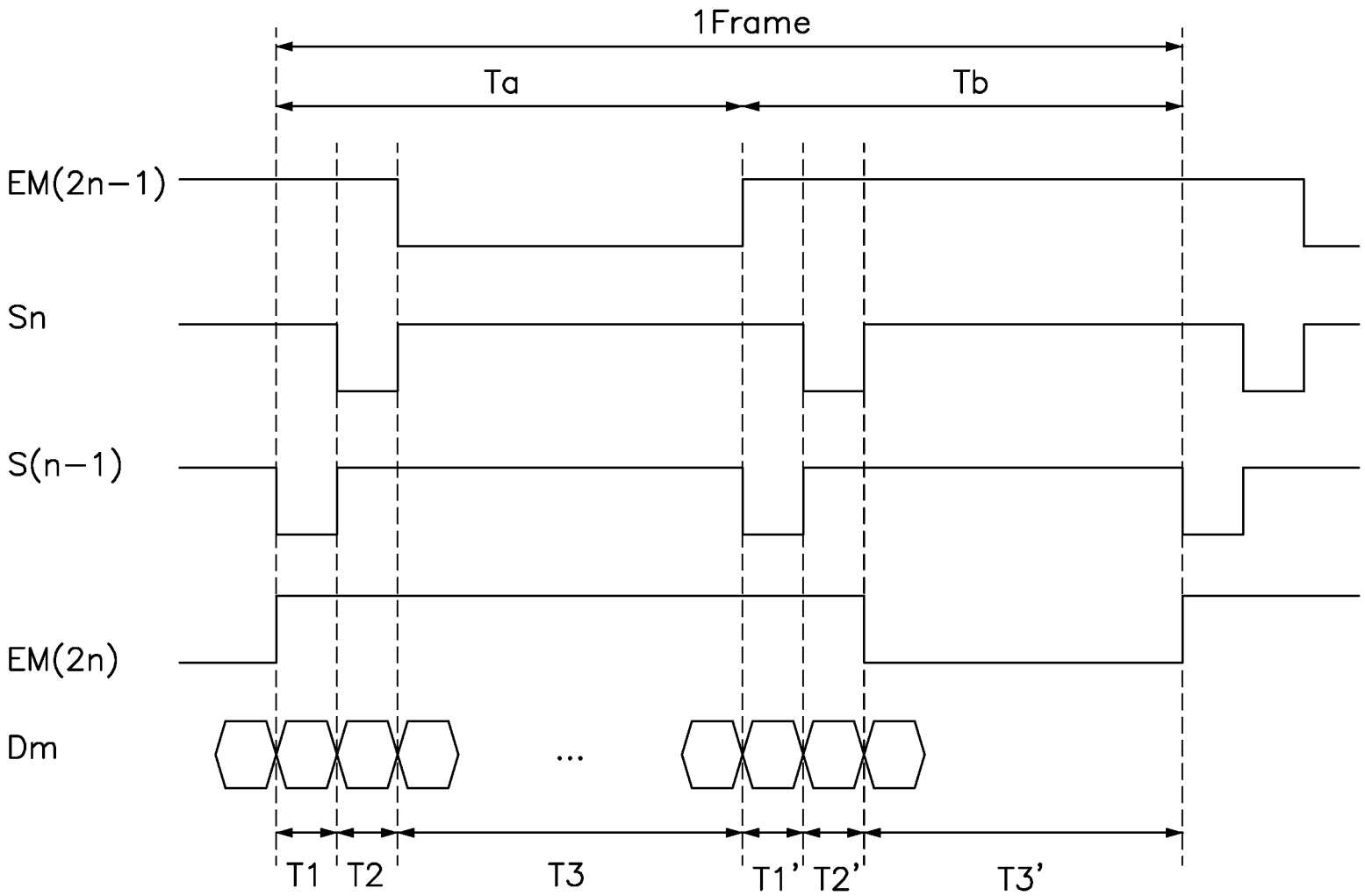
FIG. 5 is a timing chart showing waveforms of the pixel driving circuit of FIG. 4.

FIG. 5 illustrates a timing chart showing waveforms of the pixel driving circuit pixel driving circuit 300*a*. In FIG. 5, one frame of image display time is divided into a first sub-driving period Ta and a second sub-driving period Tb. In the first sub-driving period Ta, the first pixel units 10*a* in the pixel groups 100 are sequentially scanned. In the second sub-driving period Tb, the second pixel units 10*b* in the pixel groups 100 are sequentially scanned.

In FIG. 5, the first sub drive period Ta includes a reset period T1, a writing compensation period T2, and a light emitting period T3. The second sub-driving period Tb includes a reset period T1', a writing compensation period T2', and a light emitting period T3'. In this embodiment, in the first sub-driving period Ta, the pixel driving circuit 300*a* sequentially operates in the reset period T1, the writing compensation period T2, and the light emitting period T3. In the light emitting period T3 of the first sub-driving period Ta, the pixel driving circuit 300*a* drives the first light emitting element EL(n−1) of the first pixel unit 10*a* to emit light. In the second sub-driving period Tb, the pixel driving circuit 300*a* sequentially operates in the reset period T1', the writing compensation period T2', and the light emitting period T3'. In the light emitting period T3' of the second sub drive period Tb, the pixel driving circuit 300*a* drives the second light emitting element ELn of the second pixel unit 10*b* to emit light. In this embodiment, the pixel driving circuit 300*a* is a current type driving circuit.

Figure 6:
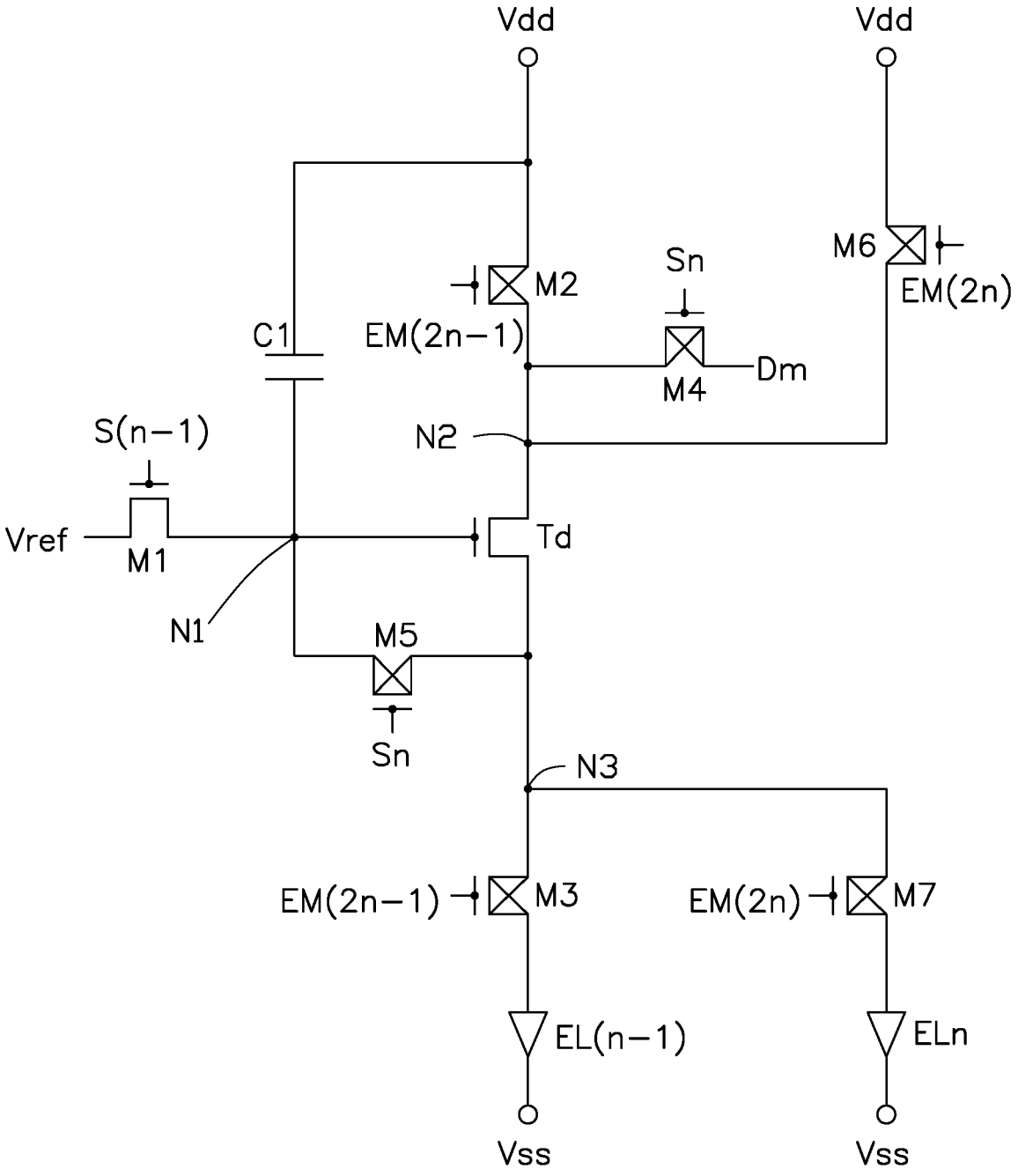
FIG. 6 is a circuit diagram of the pixel driving circuit shown of FIG. 4, which is operated in a reset period of a first sub-driving period, the elements marked "X" being turned-off.

FIG. 6 illustrates the pixel driving circuit 300 in the reset period T1 of the first sub driving period Ta.

In FIG. 5, in the reset period T1 of the first sub-driving period Ta, the signal of the scan line S(n−1) is valid (for example, low level). The signal of the scan line Sn is invalid (for example, high level). The signal of the control line EM(2*n*−1) is invalid (for example, high level). The signal of the control line EM(2*n*) is invalid (for example, high level).

In FIG. 6, in the reset module 21, the reset transistor M1 is turned on due to the signal of of the scan line S(n−1). In the common compensation module 29, the scan transistor M4 and the compensation transistor M5 are turned off due to the signal of the scan line Sn. In the first switching module 23, the first transistor M2 and the second transistor M3 are turned off due to the signal of the control line EM(2*n*−1). In the second switching module 25, the third transistor M6 and the fourth transistor M7 are turned off due to the signal of the control line EM(2*n*). That is, in the reset period T1 of the first sub-driving period Ta, only the reset transistor M1 is turned on.

In this embodiment, the gate electrode of the reset transistor M1 receives the signal of the scan line S(n−1) as the reset signal. The drain electrode of the reset transistor M1 receives the reference voltage Vref. The reference voltage Vref is transmitted to the first node N1, and thus the voltage of the control terminal 271 and the voltage of the gate electrode of the driving transistor Td are reset to the reference voltage Vref.

Figure 7:
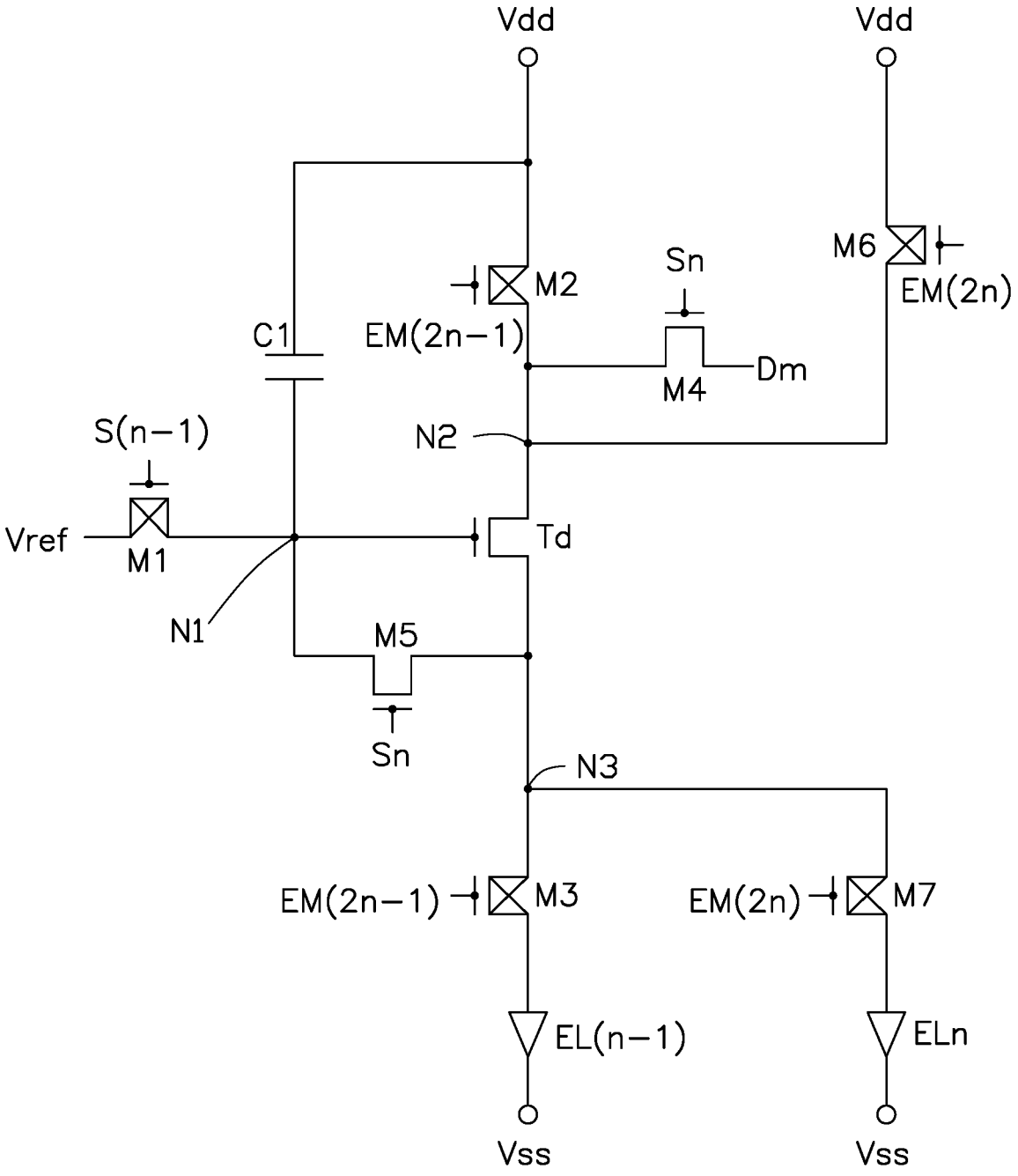
FIG. 7 is a circuit diagram of the pixel driving circuit shown of FIG. 4, which is operated in a writing compensation period of a first sub-driving period, the elements marked "X" being turned-off.

FIG. 7 illustrates the pixel driving circuit 300*a* in the writing compensation period T2 of the first sub drive period Ta.

In FIG. 5, in the writing compensation period T2 of the first sub-driving period Ta, the signal of the scan line S(n−1) is invalid (for example, high level). The signal of the scan line Sn is active (for example, low level). The signal of control line EM(2*n*−1) is invalid (for example, high level). The signal of the control line EM(2*n*) is invalid (for example, high level).

In FIG. 7, in the reset module 21, the reset transistor M1 is turned off due to the signal of the scan line S(n−1). In the first switching module 23, the first transistor M2 and the second transistor M3 are turned off due to the signal of the control line EM(2*n*−1). In the second switching module 25, the third transistor M6 and the fourth transistor M7 are turned off due to the signal of the control line EM(2*n*). In the common compensation module 29, the scan transistor M4 and the compensation transistor M5 are turned on due to the signal of the scan line Sn.

In this embodiment, the scan transistor M4 is turned on due to the signal of the scan line Sn, and the data voltage Vdata on the data line Dm is supplied to the source electrode of the driving transistor Td. The compensation transistor M5 is turned on due to the signal of the scan line Sn, the gate electrode of the driving transistor Td is electrically connected with the drain electrode of the driving transistor Td, and the driving transistor Td is served as a diode, thus the data voltage Vdata on the data line Dm is is written to the gate electrode of the driving transistor Td through the source electrode of the driving transistor Td to compensate the threshold voltage Vth of the driving transistor Td.

At this time, the voltage of the first node N1 is Vdata−Vth, and the voltage of the second node N2 is Vdata. The first terminal of the storage capacitor C1 is electrically connected to the power voltage Vdd, and the second terminal of the storage capacitor C1 is electrically connected to the first node N1. The voltage of the first terminal of storage capacitor C1 is always equal to the power voltage Vdd. The voltage of the second terminal of the storage capacitor C1 is equal to the voltage of the first node N1, that is, Vdata−Vth. Therefore, the storage voltage of the storage capacitor C1 is the difference between the power supply voltage Vdd and the first node N1 voltage Vdata−Vth. That is, the storage voltage of the storage capacitor C1 is Vdd+Vth−Vdata. Thus, the common compensation module 29 achieves the compensation of the threshold voltage Vth and the storage of the data voltage Vdata.

Figure 8:
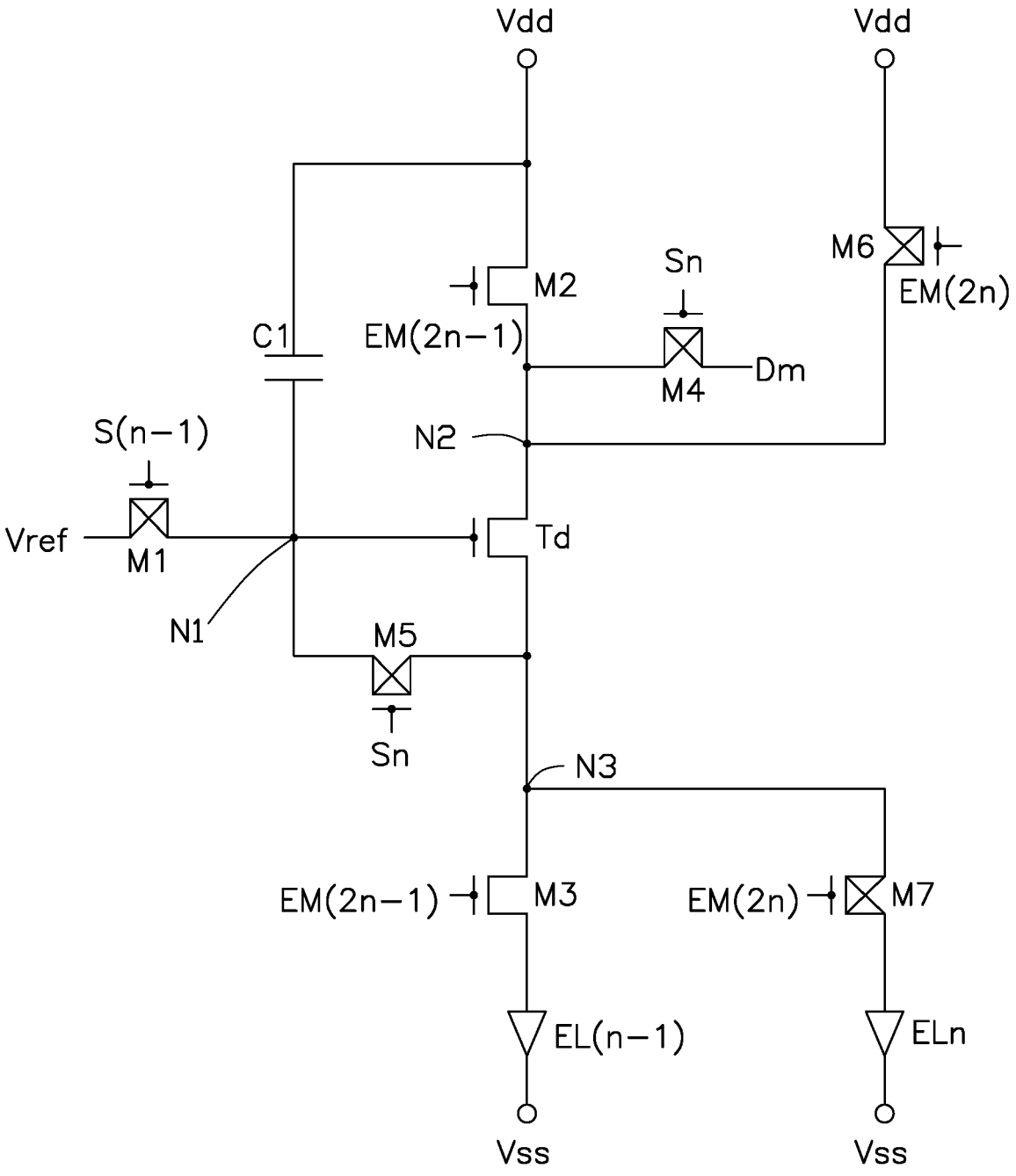
FIG. 8 is a circuit diagram of the pixel driving circuit shown of FIG. 4, which is operated in a light emitting period of a first sub-driving period, the elements marked "X" being turned-off.

FIG. 8 illustrates the pixel driving circuit 300*a* in the light emitting period T3 of the first sub-driving period Ta.

In FIG. 5, in the light emitting period T3 of the first sub-driving period Ta, the signal of the scan line S(n−1) is invalid (for example, high level). The signal of the scan line Sn is invalid (for example, high level). The signal of the control line EM(2*n*−1) is valid (for example, low level). The signal of the control line EM(2*n*) is invalid (for example, high level).

In FIG. 8, in the reset module 21, the reset transistor M1 is turned off due to the signal of the scan line S(n−1). In the first switching module 23, the first transistor M2 and the second transistor M3 are turned on due to the signal of the control line EM(2*n*−1). In the second switching module 25, the third transistor M6 and the fourth transistor M7 are turned off due to the signal of the control line EM(2*n*). In the common compensation module 29, the scan transistor M4 and the compensation transistor M5 are turned off due to the signal of the scan line Sn.

In FIG. 8, in the first switching module 23, the first transistor M2 and the second transistor M3 are turned on due to the signal of the control line EM(2*n*−1). The voltage of the second node N2 is the same as the power voltage Vdd. Since the voltage across the storage capacitor C1 remains unchanged, the voltage of the first node N1 remains at Vdata-Vth. The driving transistor Td is turned on to generate a driving current $I_{oled}$ to drive the first light emitting element EL(n−1) to emit light.

The drive current $I_{oled}$ can be calculated in the following manner:

$$\begin{aligned} I_{oled} &= k \times (Vgs - Vth)^2 \\ &= k \times [Vdd - (Vdata - Vth) - Vth]^2 \\ &= k \times (Vdd - Vdata)^2 \end{aligned}$$

Here, k is a current amplification factor of the driving transistor Td, which is related to a mobility of the driving transistor Td and a proportional constant determined by the ratio of the channel width and the channel length.

It can be seen that, the driving current $I_{oled}$ is independent of the threshold voltage Vth of the driving transistor Td and only relates to the data voltage Vdata.

In FIG. 5, the operation mode of the pixel driving circuit 300*a* in the reset period T1' and the writing compensation period T2' of the second sub-driving period Tb is the same as that in the reset period T1 and the writing compensation period T2 of the first sub-driving period Ta. Therefore, we will not repeat them here.

Figure 9:
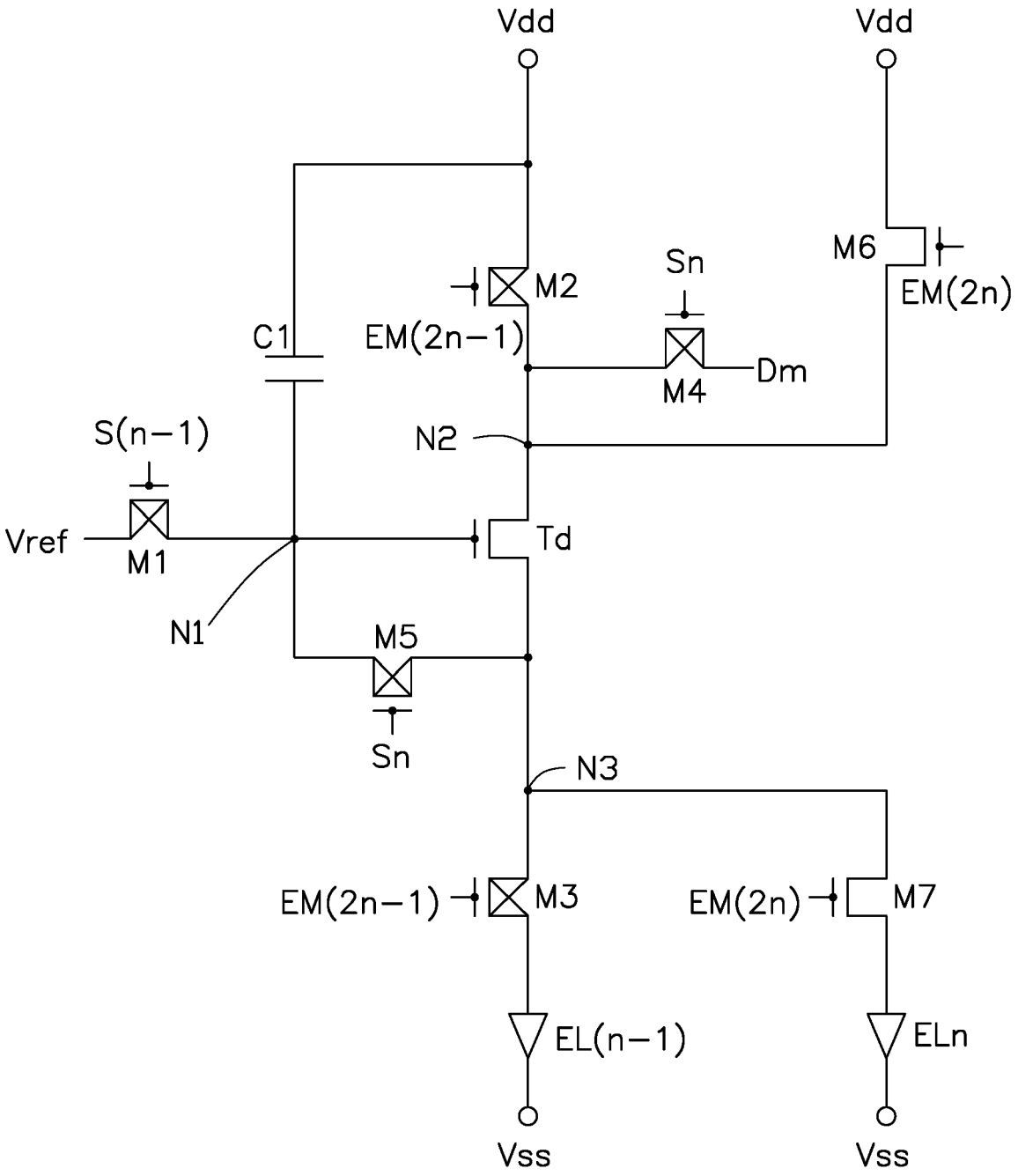
FIG. 9 is a circuit diagram of the pixel driving circuit shown of FIG. 4, which is operated in a light emitting period of a second sub-driving period, the elements marked "X" being turned-off.

FIG. 9 illustrates the pixel driving circuit 300*a* in the light emitting period T3' of the second sub-driving period Tb.

In FIG. 5, in the light emitting period T3' of the second sub-driving period Ta, the signal of the scan line S(n−1) is invalid (for example, high level). The signal of the scan line Sn is invalid (for example, high level). The signal of the control line EM(2*n*) is valid (for example, low level). The signal of control line EM(2*n*−1) is invalid (for example, high level).

In FIG. 9, in the reset module 21, the reset transistor M1 is turned off due to the signal of the scan line S(n−1). In the first switching module 23, the first transistor M2 and the second transistor M3 are turned off due to the signal of the control line EM(2*n*−1). In the second switching module 25, the third transistor M6 and the fourth transistor M7 are turned on due to the signal of the control line EM(2*n*). In the common compensation module 29, the scan transistor M4 and the compensation transistor M5 are turned off due to the signal of the scan line Sn.

In FIG. 9, in the second switching module 25, the third transistor M6 and the fourth transistor M7 are turned on due to the signal of the control line EM(2*n*). The voltage of the second node N2 is the same as the power voltage Vdd. Since the voltage across the storage capacitor C1 remains unchanged, the voltage of the first node N1 remains at Vdata-Vth. The driving transistor Td is turned on to generate a driving current $I_{oled}$ to drive the second light emitting element ELn to emit light.

In summary, in this embodiment, in the same pixel group 100, adjacent two pixel units 10 are driven by the same pixel driving circuit 300*a*, which reduces the number of pixel driving circuits and is beneficial to the narrow border design of the display device 1. In addition, in this embodiment, since the number of scan lines is reduced by half, the number of leads connected to the gate driver 20 is reduced, so that the gate driver 20 can be disposed in the display region 11, which further facilitate the narrow border design of the display device 1.

Figure 10:
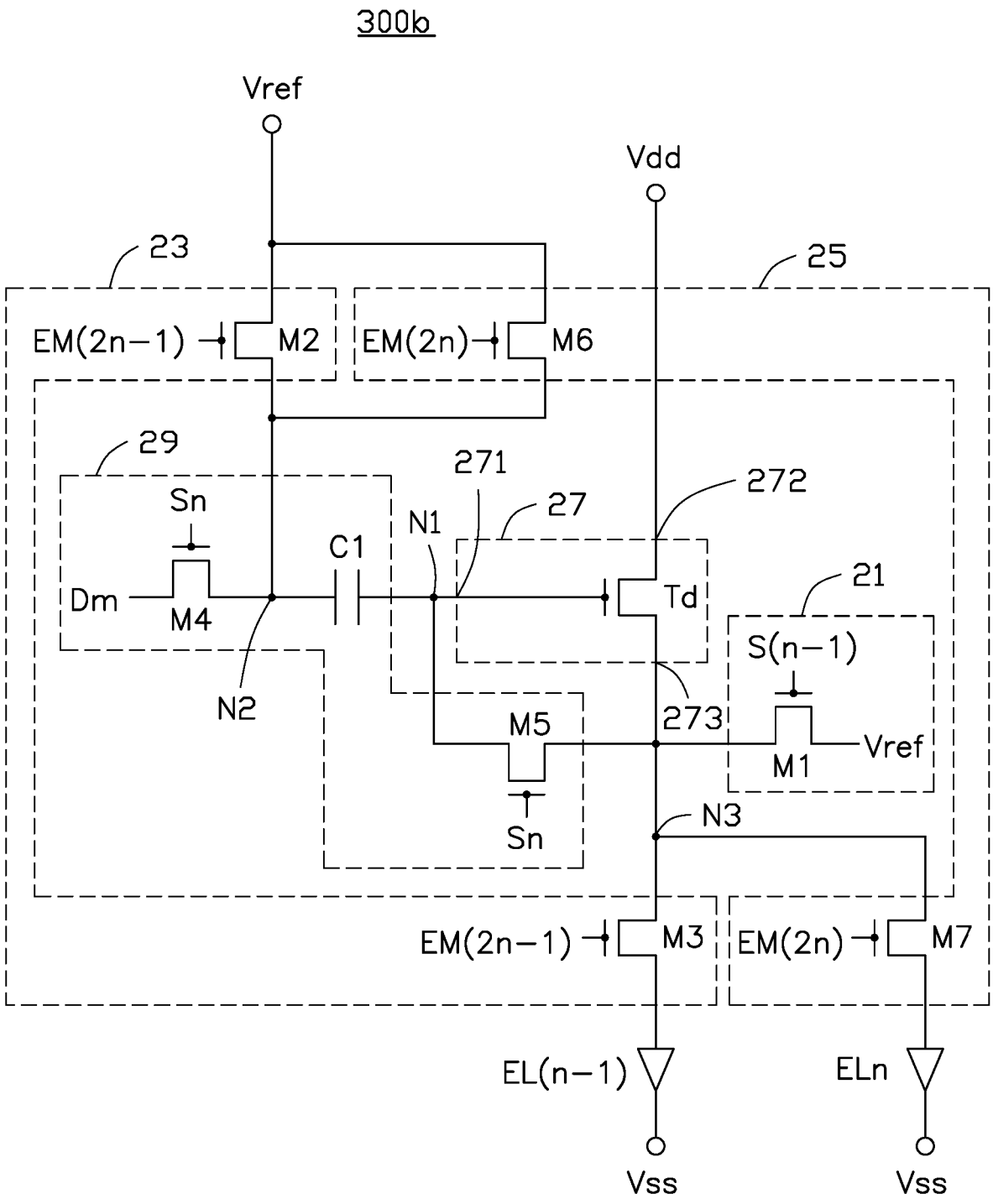
FIG. 10 is another circuit diagram view of the pixel driving circuit of FIG. 1.

FIG. 10 illustrates another pixel driving circuit 300*b* applied to the pixel group 100. FIG. 10 illustrates only one exemplary pixel group 100, and the other pixel groups 100 respectively have the same pixel driving circuit 300*b*. Each pixel group 100 includes one pixel driving circuit 300*b*. The pixel driving circuit 300*b* is electrically connected to the adjacent two scanning lines S(n−1)-Sn, one data line Dm, and the adjacent two control lines EM(2*n*−1)-EM(2*n*).

In this embodiment, the pixel driving circuit 300*b* receives the signal of the previous scan line S(n−1) as the reset signal, receives the signal of the corresponding scan line Sn as the scan signal, receives the signal of the corresponding data line Dm as a data signal, receives the signal of the control line EM(2*n*−1) as a first control signal and receives the signal of the control line EM(2*n*) as a second control signal. The scan signals of the two adjacent scan lines S(n−1)-Sn are sequentially shifted. The pixel driving circuit 300*b* drives the first pixel unit 10*a* and the second pixel unit 10*b* in the pixel group 100 in time division.

In FIG. 10, the pixel driving circuit 300*b* includes a reset module 21, a first switching module 23, a second switching module 25, a driving module 27, a common compensation module 29, a first light emitting element EL(n−1), and a second light emitting element ELn. The first light emitting element EL(n−1) corresponds to the first pixel unit 10*a*, and the second light emitting element ELn corresponds to the second pixel unit 10*b*. The circuit formed by the reset module 21, the first switching module 23, the driving module 27, and the common compensation module 29 is used to drive the first pixel unit 10*a*. The circuit formed by the reset module 21, the second switching module 25, the driving module 27, and the common compensation module 29 is used to drive the second pixel unit 10*b*. That is, the first pixel unit 10*a* and the second pixel unit 10*b* share the reset module 21, the driving module 27, and the common compensation module 29.

In this embodiment, from the perspective of circuit layout, the reset module 21, the first switching module 23, the driving module 27, and the common compensation module 29 are disposed corresponding to the first pixel unit 10*a*, and the second switching module 25 corresponds to the second pixel unit 10*b*. Alternatively, one or more of the reset module 21, the driving module 27, and the common compensation module 29 may be correspondingly disposed in the second pixel unit 10*b*.

In FIG. 10, the driving module 27 includes a control terminal 271, a first connecting terminal 272 and a second connecting terminal 273, and a driving transistor Td. In this embodiment, the driving module 27 adjusts and controls the magnitude of the driving current passing through the driving transistor Td due to the voltage stored on the side where the control terminal 271 is located, thereby controlling the brightness and the gray level of the pixel unit 10 located therein. A gate electrode of the driving transistor Td is electrically connected to the control terminal 271. A source electrode of the driving transistor Td is electrically connected to the first connecting terminal 272, and a drain electrode of the driving transistor Td is electrically connected to the second connecting terminal 273. The driving transistor Td has a threshold voltage Vth. In this embodiment, the driving transistor Td is a P-type thin film transistor.

In this embodiment, the connecting node between the control terminal 271 of the driving module 27 and the common compensation module 29 is defined as a first node N1. A connecting node of the first switching module 23, the second switching module 25, and the common compensation module 29 is defined as a second node N2. A connecting node between the second connecting terminal 273 of the driving module 27, the first switching module 23, and the second switching module 25 is defined as a third node N3.

In FIG. 10, the control terminal 271 of the driving module 27 and the common compensation module 29 are electrically connected to the first node N1. The second connecting terminal 273 of the driving module 27, the first switching module 23, and the second switching module 25 are electrically connected to the third node N3. The first connecting terminal 272 of the driving module 27 is electrically connected to the power voltage Vdd.

In this embodiment, the first switching module 23 controls whether the reference voltage Vref is provided to the common compensation module 29 due to the loaded first control signal, and controls whether the driving current generated by the driving module 27 is provided to the first light emitting element EL(n−1).

In FIG. 10, the first switching module 23 includes a first transistor M2 and a second transistor M3. The first transistor M2 is electrically connected between the reference voltage Vref and the second node N2. A gate electrode of the first transistor M2 is electrically connected to the control line EM(2*n*−1) to receive the first control signal. A source electrode of the first transistor M2 is electrically connected to the reference voltage Vref. A drain electrode of the first transistor M2 is electrically connected to the second node N2.

In FIG. 10, the second transistor M3 is electrically connected between the third node N3 and the first light emitting element EL(n−1). A gate electrode of the second transistor M3 is electrically connected to the control line EM(2*n*−1) to receive the first control signal. A source electrode of the second transistor M3 is electrically connected to the third node N3, and further electrically connected to the first connecting terminal 273 of the driving module 27. A drain electrode of the second transistor M3 is electrically connected to the first light emitting element EL(n−1). In this embodiment, the first transistor M2 and the second transistor M3 are P-type thin film transistors.

In this embodiment, the second switching module 25 controls whether the reference voltage Vref is provided to the common compensation module 29 due to the loaded second control signal, and controls whether the driving current generated by the driving module 27 is provided to the second light emitting element ELn.

In FIG. 10, the second switching module 25 includes a third transistor M6 and a fourth transistor M7. The third transistor M6 is electrically connected between the reference voltage Vref and the second node N2. A gate electrode of the third transistor M6 is electrically connected to the control line EM(2*n*) to receive the second control signal. A source electrode of the third transistor M6 is electrically connected to the reference voltage Vref. A drain electrode of the third transistor M6 is electrically connected to the second node N2.

In FIG. 10, the fourth transistor M7 is electrically connected between the third node N3 and the second light emitting element ELn. A gate electrode of the fourth transistor M7 is electrically connected to the control line EM(2*n*) to receive the second control signal. A source electrode of the fourth transistor M7 is electrically connected to the third node N3, and is further electrically connected to the second connecting terminal 273 of the driving module 27. A drain electrode of the fourth transistor M7 is electrically connected to the second light emitting element ELn. In this embodiment, the third transistor M6 and the fourth transistor M7 are P-type thin film transistors.

In this embodiment, the common compensation module 29 writes and stores a data voltage loaded on the data line Dm for compensating the voltage of the control terminal 271 and the voltage of the gate electrode of the driving transistor Td due to a loaded scanning signal, thus the driving module 27 is compensated.

In FIG. 10, the common compensation module 29 includes a scan transistor M4, a compensation transistor M5, and a storage capacitor C1. A gate electrode of the scan transistor M4 is electrically connected to the scan line Sn to receive the scan signal. A source electrode of the scan transistor M4 is electrically connected to the data line Dm to receive the compensating data voltage for compensating the voltage of the control terminal 271 and the voltage of the gate electrode of the driving transistor Td. A drain electrode of the scan transistor M4 is electrically connected to the second node N2 and is further electrically connected to the storage capacitor C1.

In FIG. 10, a gate electrode of the compensation transistor M5 is electrically connected to the scan line Sn. A source electrode of the compensation transistor M5 is electrically connected to the second connecting terminal 273 and is further electrically connected to the drain electrode of the driving transistor Td. A drain electrode of the compensation transistor M5 is electrically connected to the first node N1, and is further electrically connected to the control terminal 271 and the gate electrode of the driving transistor Td. In this embodiment, the scan transistor M4 and the compensation transistor M5 are P-type thin film transistors.

In FIG. 10, the first terminal of the storage capacitor C1 is electrically connected to the second node N2, and further electrically connected to the gate electrode of the scan transistor M4. The second terminal of the storage capacitor C1 is electrically connected to the first node N1, and further electrically connected to the control terminal 273 and the gate electrode of the driving transistor Td.

In FIG. 10, a anode of the first light-emitting element EL(n−1) is electrically connected to the drain electrode of the driving transistor Td via the second transistor M3, and a cathode of the first light-emitting device EL(n−1) is grounded. A anode of the second light emitting element ELn is electrically connected to the drain electrode of the driving transistor Td via the fourth transistor M7, and a cathode of the second light emitting element ELn is grounded.

In this embodiment, the reset module 21 receives the signal of the scan line S(n−1) as a reset signal. Due to the reset signal, the voltage of the second connecting terminal 273 of the driving module 27 is reset to the reference voltage Vref Thus, the operating state of the driving transistor Td is reset.

In FIG. 10, the reset module 21 includes a reset transistor M1. A gate electrode of the reset transistor M1 is electrically connected to the scan line S(n−1). A drain electrode of the reset transistor M1 receives the reference voltage Vref. A he source electrode of the reset transistor M1 is electrically connected to the second connecting terminal 273 of the driving module 27. and the drain electrode of the driving transistor Td. In this embodiment, the reset transistor M1 is a P-type thin film transistor.

In FIG. 5, in the first sub-driving period Ta, the pixel driving circuit 300*b* sequentially operates in the reset period T1, the writing compensation period T2, and the light emitting period T3. In the light emitting period T3 of the first sub-driving period Ta, the pixel driving circuit 300*b* drives the first light emitting element EL(n−1) of the first pixel unit 10*a* to emit light. In the second sub-driving period Tb, the pixel driving circuit 300*b* sequentially operates in the reset period T1', the writing compensation period T2', and the light emitting period T3'. In the light emitting period T3' of the second sub-driving period Tb, the pixel driving circuit 300*b* drives the second light emitting element ELn of the second pixel unit 10*b* to emit light. In this embodiment, the pixel driving circuit 300*b* is a current type driving circuit.

Figure 11:
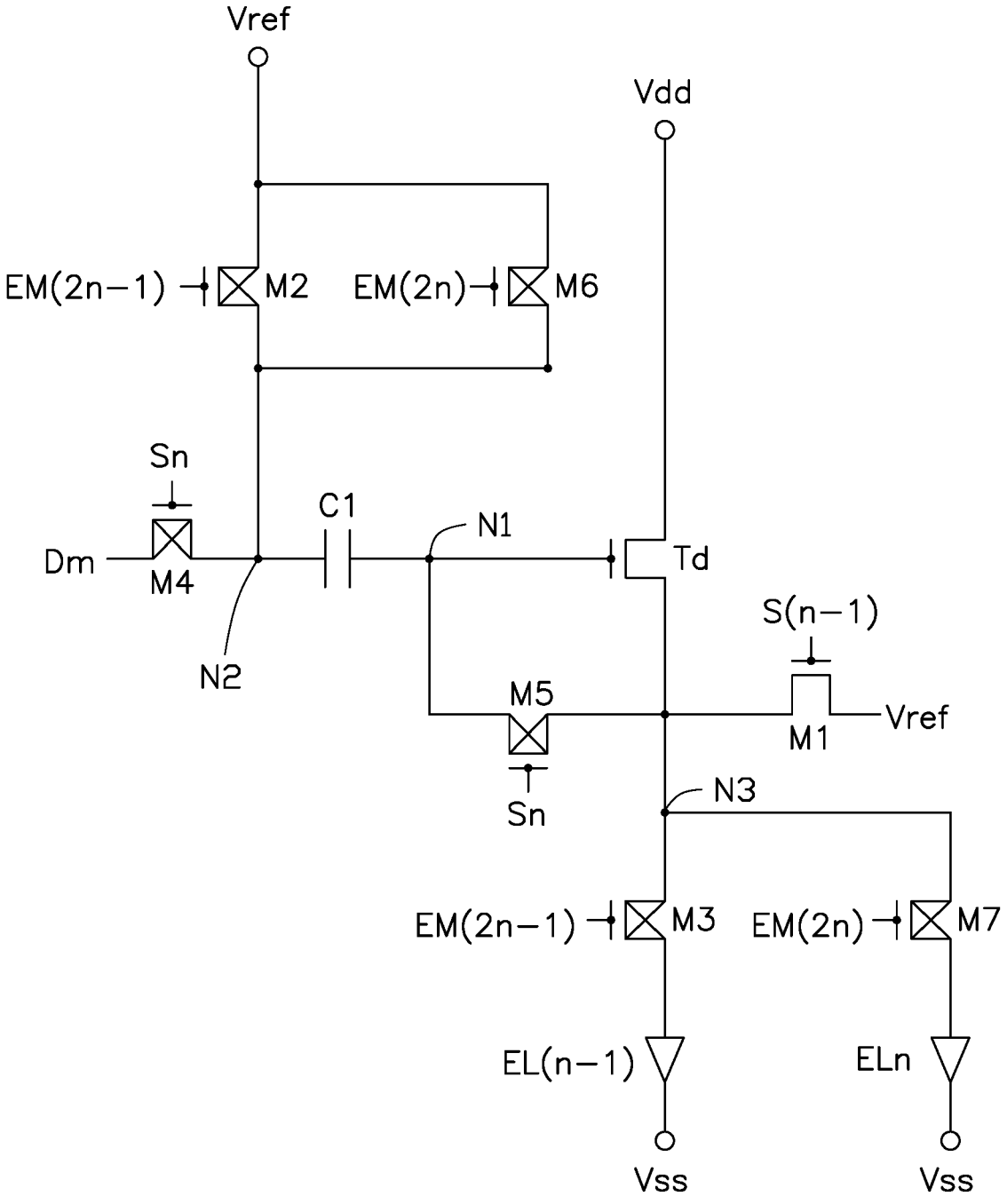
FIG. 11 is a circuit diagram of the pixel driving circuit shown of FIG. 10, which is operated in the reset period of the first sub-driving period, the elements marked "X" being turned-off.

FIG. 11 illustrates the pixel driving circuit 300*b* in the reset period T1 of the first sub driving period Ta.

In FIG. 5, in the reset period T1 of the first sub-driving period Ta, the signal of the scan line S(n−1) is valid (for example, low level). The signal of the scan line Sn is invalid (for example, high level). The signal of control line EM(2*n*−1) is invalid (for example, high level). The signal of the control line EM(2*n*) is invalid (for example, high level).

In FIG. 11, in the reset module 21, the reset transistor M1 is turned on due to the signal of the scan line S(n−1). In the common compensation module 29, the scan transistor M4 and the compensation transistor M5 are turned off due to the signal of the scan line Sn. In the first switching module 23, the first transistor M2 and the second transistor M3 are turned off due to the signal of the control line EM(2*n*−1). In the second switching module 25, the third transistor M6 and the fourth transistor M7 are turned off due to the signal of the control line EM(2*n*). That is, in the reset period T1 of the first sub-driving period Ta, only the reset transistor M1 is turned on.

In this embodiment, the gate electrode of the reset transistor M1 receives the signal of the scan line S(n−1) as the reset signal. The drain electrode of the reset transistor M1 receives the reference voltage Vref. The voltage of the terminal 273 and the voltage of the drain electrode of the driving transistor Td are reset to the reference voltage Vref.

Figure 12:
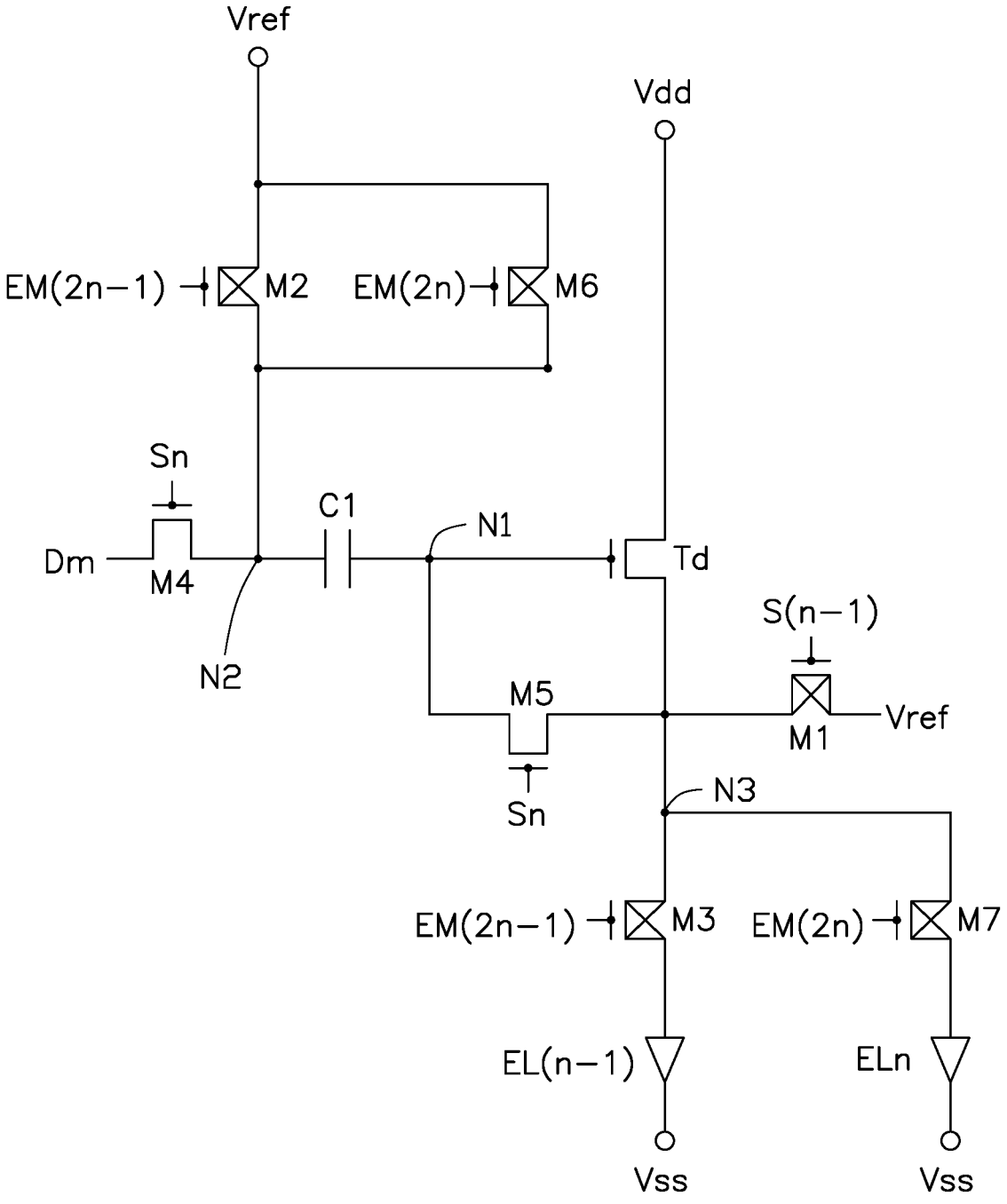
FIG. 12 is a circuit diagram of the pixel driving circuit shown of FIG. 10, which is operated in the writing compensation period of the first sub-driving period, the elements marked "X" being turned-off.

FIG. 12 illustrates the pixel driving circuit 300*b* in the writing compensation period T2 of the first sub-driving period Ta.

In FIG. 5, in the writing compensation period T2 of the first sub-driving period Ta, the signal of the scan line S(n−1) is invalid (for example, high level). The signal of the scan line Sn is active (for example, low level). The signal of control line EM(2*n*−1) is invalid (for example, high level). The signal of the control line EM(2*n*) is invalid (for example, high level).

In FIG. 12, in the reset module 21, the reset transistor M1 is turned off due to the signal of the scan line S(n−1). In the first switching module 23, the first transistor M2 and the second transistor M3 are turned off due to the signal of the control line EM(2*n*−1). In the second switching module 25, the third transistor M6 and the fourth transistor M7 are turned off due to the signal of the control line EM(2*n*). In the common compensation module 29, the scan transistor M4 and the compensation transistor M5 are turned on due to the signal of the scan line Sn.

In this embodiment, the scan transistor M4 is turned on due to the signal of the scan line Sn, and the data voltage Vdata on the data line Dm is supplied to the second node N2. The compensation transistor M5 is turned on due to the signal of the scan line Sn, the gate electrode of the driving transistor Td is electrically connected with the drain electrode of the driving transistor Td, and the driving transistor Td is served as a diode.

At this time, the voltage of the first node N1 is Vdata-Vth, and the voltage of the second node N2 is Vdata. The first terminal of the storage capacitor C1 is connected to the second node N2, and the second terminal of the storage capacitor C1 is connected to the first node N1. The voltage of the first terminal of the storage capacitor C1 is equal to the voltage of the second node N2, that is, Vdata. The voltage of the second terminal of the storage capacitor C1 is equal to the voltage of the first node N1, that is, Vdd-Vth. Therefore, the storage voltage on the storage capacitor C1 is the difference between the voltage Vdd-Vth of the first node N1 and the voltage Vdata of the second node N2, that is, the storage voltage of the storage capacitor C1 is Vdd-Vth-Vdata. Thus, the common compensation module 29 achieves the compensation of the threshold voltage Vth and the storage of the data voltage Vdata.

Figure 13:
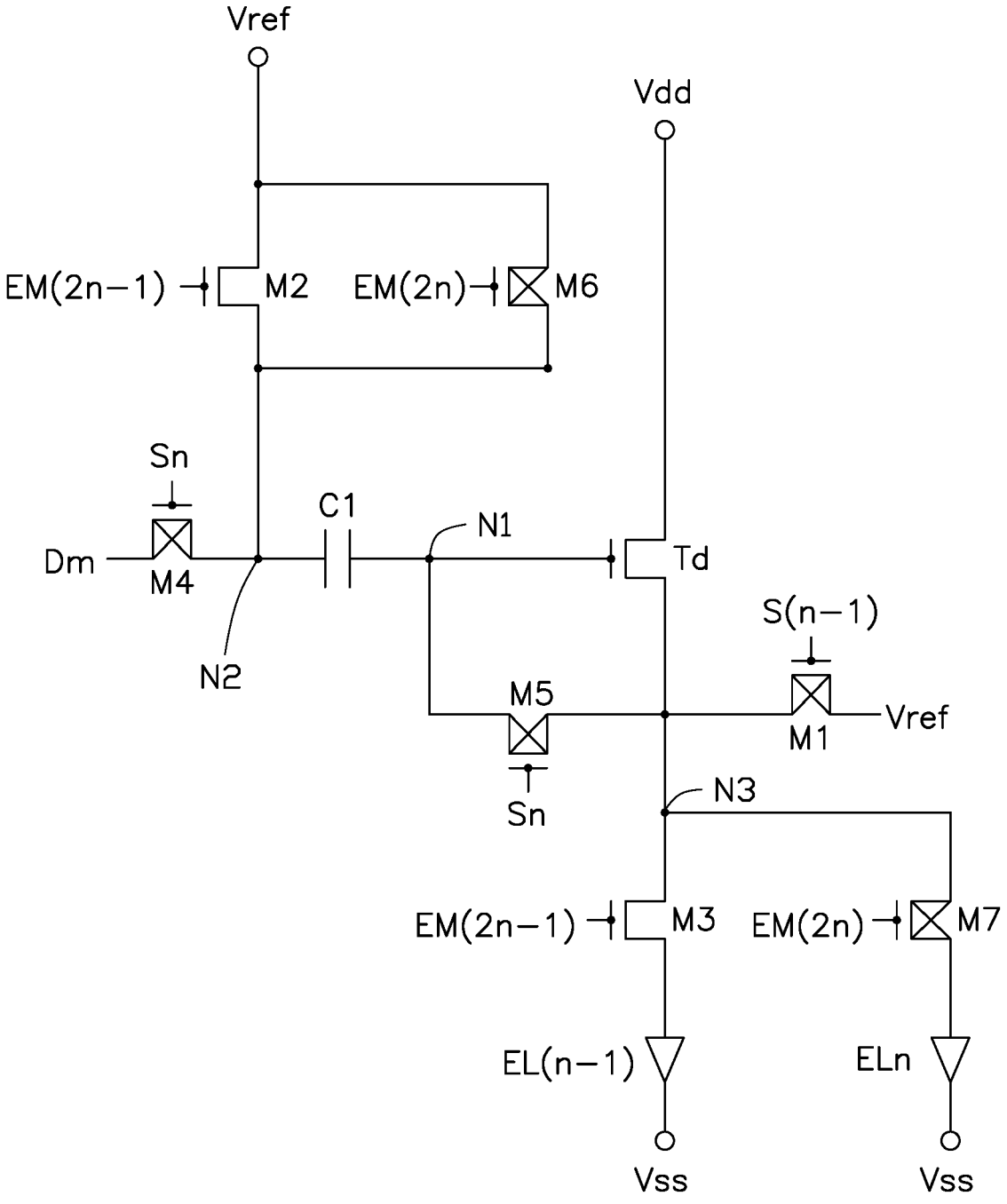
FIG. 13 is a circuit diagram of the pixel driving circuit shown of FIG. 10, which is operated in the light emitting period of the first sub-driving period, the elements marked "X" being turned-off.

FIG. 13 illustrates the pixel driving circuit 300*b* in the light emitting period T3 of the first sub-driving period Ta.

In FIG. 5, in the light emitting period T3 of the first sub-driving period Ta, the signal of the scan line S(n−1) is invalid (for example, high level). The signal of the scan line Sn is invalid (for example, high level). The signal of the control line EM(2*n*−1) is valid (for example, low level). The signal of the control line EM(2*n*) is invalid (for example, high level).

In FIG. 13, in the reset module 21, the reset transistor M1 is turned off due to the signal of the scan line S(n−1). In the first switching module 23, the first transistor M2 and the second transistor M3 are turned on due to the signal of the control line EM(2*n*−1). In the second switching module 25, the third transistor M6 and the fourth transistor M7 are turned off due to the signal of the control line EM(2*n*). In the common compensation module 29, the scan transistor M4 and the compensation transistor M5 are turned off due to the signal of the scan line Sn.

In FIG. 13, in the first switching module 23, the first transistor M2 and the second transistor M3 are turned on due to the signal of the control line EM(2*n*−1). The voltage of the second node N2 jumps to Vref. Since the voltage across the storage capacitor C1 remains unchanged, the voltage of the first node N1 becomes Vref+Vdd−Vth−Vdata. The driving transistor Td is turned on to generate a driving current $I_{oled}$ to drive the first light emitting element EL(n−1) to emit light.

At this time, the drive current $I_{oled}$ can be calculated in the following manner:

$$\begin{aligned} I_{oled} &= k \times (Vgs - Vth)^2 \\ &= k \times [Vdd - (Vref + Vdd - Vth - Vdata) - Vth]^2 \\ &= k \times (Vdata - Vref)^2 \end{aligned}$$

Here, k is a current amplification factor of the driving transistor Td, which is related to a mobility of the driving transistor Td and a proportional constant determined by the ratio of the channel width and the channel length.

It can be seen that the driving current $I_{oled}$ is independent of the threshold voltage Vth of the driving transistor Td and only relates to the data voltage Vdata.

In FIG. 5, the operation mode of the pixel driving circuit 300*b* in the reset period T1' and the writing compensation period T2' of the second sub-driving period Tb is the same as that in the reset period T1 and the writing compensation period T2 of the first sub-driving period Ta. Therefore, we will not repeat them here.

FIG. 9 illustrates the pixel driving circuit 300*b* in the light emitting period T3' of the second sub-driving period Tb.

In FIG. 5, during the light emitting period T3' of the second sub-driving period Ta, the signal of the scan line S(n−1) is invalid (for example, high level). The signal of the scan line Sn is invalid (for example, high level). The signal of the control line EM(2*n*) is valid (for example, low level). The signal of control line EM(2*n*−1) is invalid (for example, high level).

Figure 14:
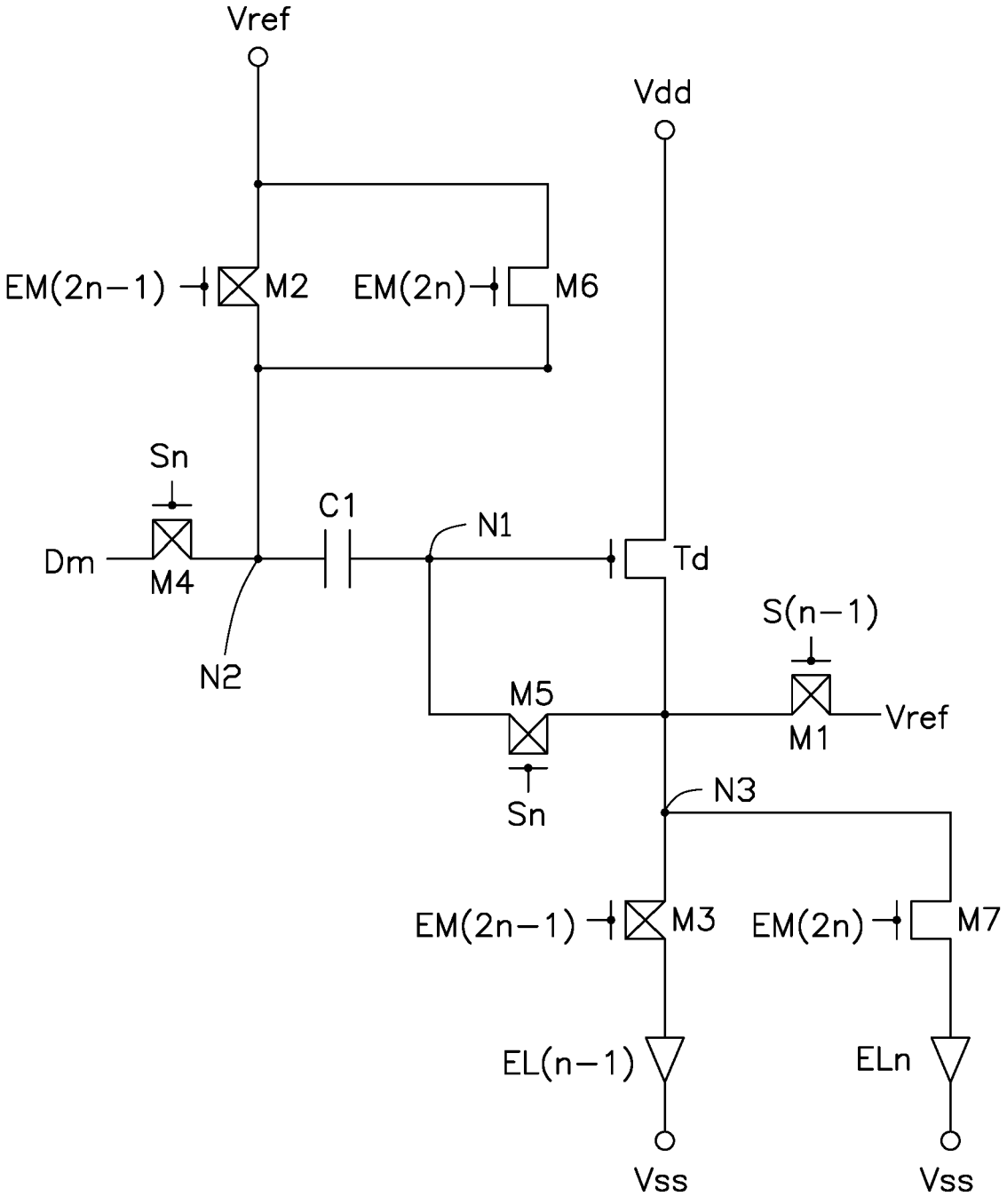
FIG. 14 is a circuit diagram of the pixel driving circuit shown of FIG. 10, which is operated in the light emitting period of the second sub-driving period, the elements marked "X" being turned-off.

In FIG. 14, in the reset module 21, the reset transistor M1 is turned off due to the signal of the scan line S(n−1). In the first switching module 23, the first transistor M2 and the second transistor M3 are turned off due to the signal of the control line EM(2*n*−1). In the second switching module 25, the third transistor M6 and the fourth transistor M7 are turned on due to the signal of the control line EM(2*n*). In the common compensation module 29, the scan transistor M4 and the compensation transistor M5 are turned off due to the signal of the scan line Sn.

In FIG. 14, in the second switching module 25, the third transistor M6 and the fourth transistor M7 are turned on due to the signal of the control line EM(2*n*). The voltage of the second node N2 jumps to Vref. Since the voltage across the storage capacitor C1 remains unchanged, the voltage of the first node N1 becomes Vref+Vdd−Vth−Vdata. The driving transistor Td is turned on to generate a driving current $I_{oled}$ to drive the second light emitting element ELn to emit light.

In summary, in this embodiment, in the same pixel group 100, adjacent two pixel units 10 are driven by the same pixel driving circuit 300*b*, which reduces the number of pixel driving circuits and is beneficial to the narrow border design of the display device 1. In addition, in this embodiment, since the number of scan lines is reduced by half, the number of leads connected to the gate driver 20 is reduced, so that the gate driver 20 can be disposed in the display region 11, which further facilitates the narrow border design of the display device 1.

In the pixel driving circuit 300*a*, the data voltage is written to the gate electrode of the driving transistor Td through the source electrode of the driving transistor Td, and in contrast, the data voltage in the pixel driving circuit 300*b* is directly written to the gate electrode of the driving transistor Td, which simplifies the writing operation.

It is to be understood, even though information and advantages of the present embodiments have been set forth in the foregoing description, together with details of the structures and functions of the present embodiments, the disclosure is illustrative only. Changes may be made in detail, especially in matters of shape, size, and arrangement of parts within the principles of the present embodiments to the full extent indicated by the plain meaning of the terms in which the appended claims are expressed.

What is claimed is:

1. A display device, comprising a plurality of pixel units, two adjacently disposed pixel units of the plurality of pixel units defining a pixel group, the pixel group comprising a first pixel unit and a second pixel unit, the first pixel unit comprising a first light emitting element, and the second pixel unit comprising a second light emitting element, wherein each pixel group comprises one pixel driving circuit, the pixel driving circuit is capable of driving the first pixel unit and the second pixel unit in one same pixel group, and the pixel driving circuit comprises:

a driving module, located in one of the first pixel unit and the second pixel unit in one same pixel group, and the driving module comprising a control terminal, a first connecting terminal, a second connecting terminal, and a driving transistor, and the control terminal being capable of storing voltage, the driving module configured to adjust and control a magnitude of an electrical signal passing through the driving transistor due to a voltage stored at the control terminal;

a first switching module, located in the first pixel unit in one same pixel group, and the first switching module configured to provide a driving current generated by the driving module to a first light emitting element due to a loaded first control signal; and a second switching module, located in the second pixel unit in one same pixel group, and the second switching module configured to provide the driving current generated by the driving module to the second light emitting element in one same pixel group due to a loaded second control signal;

wherein the pixel driving circuit further comprises:

a common compensation module electrically connected to the control terminal, and the common compensation module writes and stores a data voltage for compensating the voltage of the control terminal due to a loaded scanning signal; and a reset module electrically connected with the driving module, and the reset module resets an operating state of the driving transistor due to a loaded reset signal;

wherein the driving module, the first switching module, the common compensation module, and the reset module are configured to drive the first pixel unit;

the driving module, the second switching module, the common compensation module, and the reset module are configured to drive the second pixel unit; and the first pixel unit and the second pixel unit of the same pixel group share the driving module, the common compensation module, and the reset module;

wherein the display device further comprises a source driver, a gate driver, and a control circuit;

the source driver provides the data voltage to the common compensation module;

the gate driver provides the loaded scanning signal to the common compensation module and provides the loaded reset signal to the reset module;

the control circuit provides the loaded first control signal to the first switching module and provides the loaded second control signal to the second switching module; and the display device defines a display region and a non-display region surrounded with the display region, the gate driver is disposed in the display region, the source driver and the control circuit are disposed in the non-display region.

2. The display device of claim 1, wherein every one frame of image display time of the display device is divided into a first sub-driving period and a second sub-driving period;

the pixel driving circuits separately drives the first pixel unit and the second pixel unit of the same pixel group in the first sub-driving period and the second sub-driving period.

3. A display device, comprising a plurality of pixel units, two adjacently disposed pixel units of the plurality of pixel units defining a pixel group, the pixel group comprising a first pixel unit and a second pixel unit, the first pixel unit comprising a first light emitting element, and the second pixel unit comprising a second light emitting element, wherein each pixel group comprises one pixel driving circuit, the pixel driving circuit is capable of driving the first pixel unit and the second pixel unit in one same pixel group, and the pixel driving circuit comprises:

a driving module, located in one of the first pixel unit and the second pixel unit in one same pixel group, and the driving module comprising a control terminal, a first connecting terminal, a second connecting terminal, and a driving transistor, and the control terminal being capable of storing voltage, the driving module configured to adjust and control a magnitude of an electrical signal passing through the driving transistor due to a voltage stored at the control terminal;

a first switching module, located in the first pixel unit in one same pixel group, and the first switching module configured to provide a driving current generated by the driving module to a first light emitting element due to a loaded first control signal; and a second switching module, located in the second pixel unit in one same pixel group, and the second switching module configured to provide the driving current generated by the driving module to the second light emitting element in one same pixel group due to a loaded second control signal;

wherein the pixel driving circuit further comprises:

a common compensation module electrically connected to the control terminal, and the common compensation module writes and stores a data voltage for compensating the voltage of the control terminal due to a loaded scanning signal; and a reset module electrically connected with the driving module, and the reset module resets an operating state of the driving transistor due to a loaded reset signal;

wherein the driving module, the first switching module, the common compensation module, and the reset module are configured to drive the first pixel unit;

the driving module, the second switching module, the common compensation module, and the reset module are configured to drive the second pixel unit; and the first pixel unit and the second pixel unit of the same pixel group share the driving module, the common compensation module, and the reset module;

wherein the display device further comprises a source driver and two gate drivers;

the source driver provides the data voltage to the common compensation module;

one of the two gate drivers provides the loaded scan signal to the common compensation module and the loaded reset signal to the reset module;

the other of the two gate drivers provides the loaded first control signal to the first switching module and the loaded second control signal to the second switching module.

4. The display device of claim 3, wherein every one frame of image display time of the display device is divided into a first sub-driving period and a second sub-driving period;

the pixel driving circuits separately drives the first pixel unit and the second pixel unit of the same pixel group in the first sub-driving period and the second sub-driving period.

* * * * *